US009493901B2

(12) United States Patent
Bolduan et al.

(10) Patent No.: US 9,493,901 B2
(45) Date of Patent: Nov. 15, 2016

(54) RINSING ARRANGEMENT FOR A DOMESTIC APPLIANCE FOR THE CARE OF LAUNDRY ITEMS, AND DOMESTIC APPLIANCE FOR THE CARE OF LAUNDRY ITEMS

(71) Applicant: BSH BOSCH UND SIEMENS HAUSGERÄTE GMBH, Munich (DE)

(72) Inventors: Edwin Bolduan, Berlin (DE); Andre Sabalat, Berlin (DE); Alexander Schlitzer, Berlin (DE)

(73) Assignee: BSH HAUSGERATE GMBH, Munich (DE)

( * ) Notice: Subject to any disclaimer, the term of this patent is extended or adjusted under 35 U.S.C. 154(b) by 153 days.

(21) Appl. No.: 14/367,725

(22) PCT Filed: Dec. 17, 2012

(86) PCT No.: PCT/EP2012/075794

§ 371 (c)(1),
(2) Date: Jun. 20, 2014

(87) PCT Pub. No.: WO2013/092491

PCT Pub. Date: Jun. 27, 2013

(65) Prior Publication Data

US 2014/0352804 A1 Dec. 4, 2014

(30) Foreign Application Priority Data

Dec. 21, 2011 (DE) ..... 10 2011 089 390
Oct. 11, 2012 (DE) ..... 10 2012 218 549

(51) Int. Cl.
*D06F 39/02* (2006.01)
*D06F 39/08* (2006.01)

(52) U.S. Cl.
CPC ..... *D06F 39/088* (2013.01); *D06F 39/02* (2013.01); *D06F 39/022* (2013.01); *D06F 39/028* (2013.01); *Y10T 137/6851* (2015.04)

(58) Field of Classification Search
CPC .... D06F 39/02; D06F 39/022; D06F 39/028; D06F 39/08; D06F 39/083; D06F 39/087; D06F 39/088; Y10T 137/6851
USPC ..... 137/123
See application file for complete search history.

(56) References Cited

U.S. PATENT DOCUMENTS 2,673,537 A * 3/1954 Eastman ..... D05B 15/00 112/35
7,093,467 B2 * 8/2006 Kim ..... D06F 39/02 134/93

(Continued)

FOREIGN PATENT DOCUMENTS

CN 201099775 8/2008
CN 101341285 A 1/2009

(Continued)

OTHER PUBLICATIONS

International Search Report for PCT/EP2012/075794, mailed Nov. 27, 2013.

(Continued)

*Primary Examiner* — Mary McManmon
*Assistant Examiner* — Richard K Durden
(74) *Attorney, Agent, or Firm* — Nixon & Vanderhye, P.C.

(57) ABSTRACT

The invention relates to a rinsing arrangement (8) for a domestic appliance (1) for the care of laundry items, comprising a rinsing dish (8*a*) that has an upper portion (8*b*) and a lower portion (8*c*) connectable to thereto, wherein a water supply device (8*d*) having a water receiving tray is formed in the lower portion (8*c*), and an outlet connector (8*e*, 8*f*) is formed on the lower portion (8*c*), which opens into the water receiving tray, wherein a dividing wall (31) that is separate from the lower portion (8*c*) and can be attached to the lower portion (8*c*) is formed, and in the arranged state of the dividing wall (31), a siphon (8*n*) is formed between the outlet connector (8*e*, 8*f*) and a water receiving space (8*j*) formed in the lower portion (8*c*). The invention further relates to a domestic appliance (1) having a rinsing arrangement (8).

15 Claims, 4 Drawing Sheets

(56) References Cited

U.S. PATENT DOCUMENTS

| | | | | |
|---|---|---|---|---|
| 7,481,082 | B2 * | 1/2009 | Cho | D06F 39/028 68/17 R |
| 2008/0148786 | A1 * | 6/2008 | Bolduan | D06F 39/02 68/17 R |
| 2011/0067456 | A1 | 3/2011 | Quandt | |

FOREIGN PATENT DOCUMENTS

| | | | | |
|---|---|---|---|---|
| DE | 19847486 | | 12/1999 | |
| DE | 10 2004 060709 | | 6/2006 | |
| DE | 10 2005 012424 | | 9/2006 | |
| DE | 10 2009 030329 | | 1/2010 | |
| FR | 591 245 | | 6/1925 | |
| FR | 2 629 486 | | 10/1989 | |
| GB | 2187764 | A * | 9/1987 | D06F 39/02 |
| NL | EP 0247686 | A2 * | 12/1987 | D06F 39/02 |

OTHER PUBLICATIONS

Foreign-language Written Opinion of the International Searching Authority for PCT/EP2012/075794, mailed Nov. 27, 2013.

* cited by examiner

RINSING ARRANGEMENT FOR A DOMESTIC APPLIANCE FOR THE CARE OF LAUNDRY ITEMS, AND DOMESTIC APPLIANCE FOR THE CARE OF LAUNDRY ITEMS

This application is a National Phase of International Application No. PCT/EP2012/075794, filed on Dec. 17, 2012, which designed the U.S. and claims priority to DE Application No. 10 2011 089 390.3, filed on Dec. 21, 2011; and DE Application No. 10 2012 218 549.6, filed on Oct. 11, 2012, the entire contents of each of which are hereby incorporated by reference.

The invention relates to a rinsing arrangement and a domestic appliance for the care of laundry items, comprising a rinsing dish and a tub which is connected to the rinsing dish via a supply line, wherein a steam stop facility is embodied in a curved section in the supply line.

BACKGROUND

A washing machine with a controllable fresh water intake for at least two detergent chambers is known from DE 10 2006 029 953 A1. Disposed in an upper area of the housing of the washing machine is a detergent flushing arrangement. Detergent supply lines lead downwards from an uneven floor of the housing of this detergent flushing arrangement to open out at a door seal on one side and to open out at a tub on the other side.

This detergent flushing arrangement also provides ventilation of the tub without an additional ventilation line. Further, because of the two separate detergent supply lines and their connection to the floor of the housing of this detergent supply device it is guaranteed that one of these two lines is always unoccupied.

A rinsing arrangement with a water supply for a washing machine is known from DE 10 2004 060 709 A1. A rinsing dish of the rinsing arrangement is embodied with an upper portion and a lower portion, wherein the lower portion has an outlet connector and a tray as a water supply. A dividing wall projects from above into the water contained in the tray, which divides the lower portion in conjunction with the water contained in the tray and the water stop formed thereby, also called steam stop below, into two compartments separated from one another. The dividing wall is embodied in one piece on the lower portion or preferably with the upper portion. This makes the manufacturing of the components very complex and difficult, especially if they are embodied as injection-molded parts. The outlet connector of the rinsing arrangement is connected to a tub of a washing machine.

The steam stop can be filled with water to a maximum up to its overflow at the outlet connector. In the event of vibrations and fluctuating pressure conditions, as can occur when an opening for loading the washing machine is opened, unwanted water can enter the tub from the steam stop. This is especially disadvantageous at the end of the washing program since it causes the laundry which has already been spun to become wet again. Such an effect must above all be prevented when the outlet connector for direct wetting of the laundry is connected to a door seal disposed on the tub.

SUMMARY

The object of the present invention is to create a rinsing arrangement and a domestic appliance for the care of laundry items in which a compact structure of a liquid flushing inlet on the one hand and ventilation on the other hand is achieved and manufacturing is simplified. Above and beyond this, when a loading opening of the domestic appliance is opened and closed, unwanted wetting of the laundry with liquid from a water supply or a steam stop is to be avoided.

This object is achieved by a rinsing arrangement and a domestic appliance in accordance with the independent claims.

An inventive rinsing arrangement for a domestic appliance for the care of laundry items includes a rinsing dish which has an upper portion and a lower portion able to be connected thereto, wherein a water supply device with a water-receiving tray is embodied in the lower portion and an outlet connector is embodied on the lower portion, which opens into the water-receiving tray. A dividing wall which can be attached to the lower portion is embodied separately from the lower portion and, when the dividing wall is in place, a siphon is formed between the outlet connector and the water-receiving tray. The one-piece manufacturing of the lower portion is simplified and made less expensive by such a design. It is precisely when manufactured as an injection-molded part that the embodiment and shaping of a siphon is extremely difficult and error-prone. The fact that the dividing wall almost is be manufactured independently and provided as a separate component and only later is fitted and able to be removed again as a non-destructively releasable component means that these problems are rectified during manufacturing, but on the other hand the desired embodiment of a siphon is still achieved.

It is especially advantageous for the dividing wall to be able to be latched onto the lower portion to attach it. This makes a very rapid and positionally-secure installation possible, wherein the dividing wall can then also be easily removed again.

Preferably the lower portion has a sub-channel of a ventilation channel integrated into the rinsing dish opening onto the outlet connector. Such an embodiment of the rinsing dish enables a highly-integrated system of a steam stop on the one hand and a corresponding ventilation on the other hand to be achieved. A steam stop within the context of the invention is an essentially U-shaped tube system, with the tube sections of the tube system communicating with one another able to be filled with a liquid medium to a level so that it is not possible for gaseous medium to flow through the system. The steam stop is effective when the tube system is filled to this level. The tube system can also have a shape other than the U shape, provided the tube sections of the tube system communicating with one another can act in the same way to provide such a steam stop.

Preferably there is provision for the sub-channel to be delimited by a wall which is also a delimiting wall of a water-receiving space of the rinsing dish. The compact embodiment is promoted by this design. In particular however an especially significant variant in respect of the condensation of the gaseous medium conveyed via the ventilation channel is achieved by this.

Preferably there is provision for the sub-channel to be essentially embodied over the entire length of a water-receiving space of the rinsing dish in the lower portion.

In particular there is provision for the sub-channel to be closed off by a second sub-channel in the upper portion, when the lower portion is connected to the upper portion.

In particular there is provision for the ventilation channel to be routed from a front end of the lower portion on which the outlet connector is disposed to a rear end of the lower portion and upwards into the upper portion and from there to the front end again, emerging at an outlet opening. An especially long path in the rinsing dish for the gas flow is achieved by this, which is especially routed over an especially long path along the water-receiving space. The desired condensation is particularly encouraged by this.

Preferably there is provision for a dividing wall separate from the lower portion to be embodied, which is able to be attached to the lower portion and, when said wall is in place, for a siphon to be formed between the outlet connector and the water-receiving tray.

Preferably there is provision for the upper portion to have a guide wall, by which, in the assembled state of the upper portion with the lower portion, the interior of the rinsing dish is divided into two rinsing channels.

In particular there is provision for a first rinsing channel with the water supply device to be embodied as a steam stop.

Preferably a second rinsing channel with the water supply device is embodied as a connection to a tub of the domestic appliance.

Furthermore a siphon is preferably formed between the outlet connector and a water-receiving space formed in the lower portion and the siphon has a first overflow to the outlet connector and a second overflow to a further outlet, especially a second outlet connector, wherein the overflow level of the first overflow (first overflow level) is disposed higher than the overflow level of the second overflow (second overflow level). This inventive arrangement has the advantage that, with a siphon completely filled with liquid, in the event of vibrations or fluctuations in pressure, the liquid can escape via the second overflow to the further outlet from the siphon. An escape of the liquid from the siphon via the first overflow to the outlet connector can thus be effectively avoided. This is of particular advantage if the outlet connector is connected to a tub of the domestic appliance or to an opening of a door seal disposed on the tub and a flow of liquid escaping from the opening wetting the laundry items introduced into a drum of the domestic appliance directly with the liquid. In this case, with the inventive arrangement, an unwanted wetting of the laundry items with liquid from the siphon can be avoided.

Preferably an overflow channel is disposed between the water supply device and the further outlet having a smaller cross-sectional surface than the cross-sectional surface of the outlet connector, wherein the vertical position of the overflow channel is disposed below the overflow level of the first overflow. The second overflow is particularly preferably formed by the overflow channel. The cross-sectional surface of the overflow channel is especially designed so that, during a rinsing process, the water or liquid supplied to the rinsing arrangement will essentially escape via the siphon and the first overflow on the outlet connector. In this case the cross-sectional surface of the overflow channel is dimensioned small enough for the water or the liquid, at the inflow rate predetermined for the rinsing process, not to be able to escape completely via the overflow channel, which is why the water or fluid level in the siphon rises and on reaching the first overflow level will escape via the first overflow from the outlet connector. Thus in a rinsing process for example the escape of the supplied water or the supplied liquid from the output connector or from the further outlet can be controlled by a variation of the inflow rate.

In particular a first and a second outflow connector are disposed on the rinsing arrangement, wherein the first outflow connector is connected to the first overflow and the second outflow connector to the second overflow, meaning that the second outflow connector is the further outlet.

Furthermore the invention relates to a domestic appliance the care of laundry items, especially a washing machine or a washer-dryer, having an inventive rinsing arrangement or an advantageous embodiment thereof.

A preferred domestic appliance for the care of laundry items includes a rinsing dish and a tub which is connected to the rinsing dish by at least one supply line. Liquid medium, especially detergent and water, is supplied via the supply line to the door seal or to the tub. Embodied in the supply line is a steam stop facility in a curved line section. Embodied in the line section is a ventilation channel which emerges at a first end of the line section. At the first end this ventilation channel is separated from a supply channel belonging to the steam stop facility for supply of liquid medium from the rinsing dish to the tub. Thus a line section is formed in which, at a first end, both the ventilation channel and also the supply channel emerge and at this first end these two channels are also embodied separately from one another. Thus two different channels are integrated into this line section in an extremely compact and space-saving embodiment but are still designed separately from one another. Through this a line section with a connection to this first end is also generated which has two channels. The connection of two separate lines is no longer necessary, but a connection is to all intents and purposes only made via this first end. A line section is thus created having an integrated multi-way system, wherein a water supply system and an air channel system are realized in one component for this purpose. To this end separate air and water paths are realized at the front end. This forms a steam stop in the water supply which prevents steam or condensation escaping from a tub. In addition in functional terms of ventilation in the area of the cold water supply of the rinsing dish is achieved through the warm process air. This brings about a temperature equalization and prevents water condensation. An effective prevention of an escape of steam from the filling device, which is formed by the tub and the drum, is achieved.

Preferably there is provision for the first end of the line section to be an upper end viewed in terms of level. This enables the conceptual realization of the steam stop on the one hand and the ventilation on the other hand to be achieved especially securely and an especially simple connection option to the rinsing dish is guaranteed.

Preferably there is provision for areas of the ventilation channel to be embodied around the circumference of the supply channel at the first end. The fact that it does not line completely around the circumference also means that a particularly mechanically stable embodiment is realized and an especially suitable positioning of the ventilation channel and the supply channel is achieved. In particular the ventilation can then be embodied positionally quite specifically at this first end and at the transition into a rinsing dish and a ventilation channel there can be made in an especially targeted way and also with a good seal.

Preferably there is provision for the ventilation channel to emerge at an entry point into the supply channel, wherein the entry point, viewed in terms of level, lies above a liquid level in the supply channel at which the steam stop is embodied. This entry point is thus embodied at the end of this ventilation channel facing away from the first end of the line section and thus at a point displaced inwards in the line section.

Preferably there is provision for the supply channel, after the confluence of the ventilation channel, to have a flexible canal section, especially for this flexible canal section to be embodied as a corrugated tube. Such an embodiment enables an otherwise especially rigidly embodied line section or supply line to experience a degree of reversible deformability, so that it does not experience any damage when the system moves during operation of the domestic appliance.

Preferably there is provision for the supply line to be embodied as a one-piece component in the form of the line section itself, especially to be embodied as an injection-molded part.

This filling hose or this line section has the effect of connecting the filling arrangement with the rinsing dish and the detergent dispenser through to the tub. In such cases this line section also has the task of transporting the process water into the tub. As a result of the dynamic movements of the washing unit or of the suspension system, movements of this line section are especially compensated for by a flexible fold area or the flexible channel section already mentioned.

The quite specific embodiment of the line section means that said section simultaneously transports the heated process air to a condensation area in the rinsing arrangement. The special feature lies in the air guide being integrated into the line section but being transported via a channel course separate from the path of the water. Transport back via the water path is excluded by the predetermined water supply device. The passage cross-section needed for the air guide is especially achieved by an eccentric arrangement of a connector in connector. Through this, as well as an especially space-saving concept embodying a simple connection principle, a mechanically stable and robust concept is also made possible.

The sealing of the inner and outer connectors is advantageously achieved by specific sealing elements or sealing ribs. The hose connection can be additionally secured by suitable hose clips on the outer connector.

BRIEF DESCRIPTION OF THE DRAWINGS

An exemplary embodiment of the invention is explained in greater detail below with reference to schematic drawings, in which.

DETAILED DESCRIPTION

Figure 1:
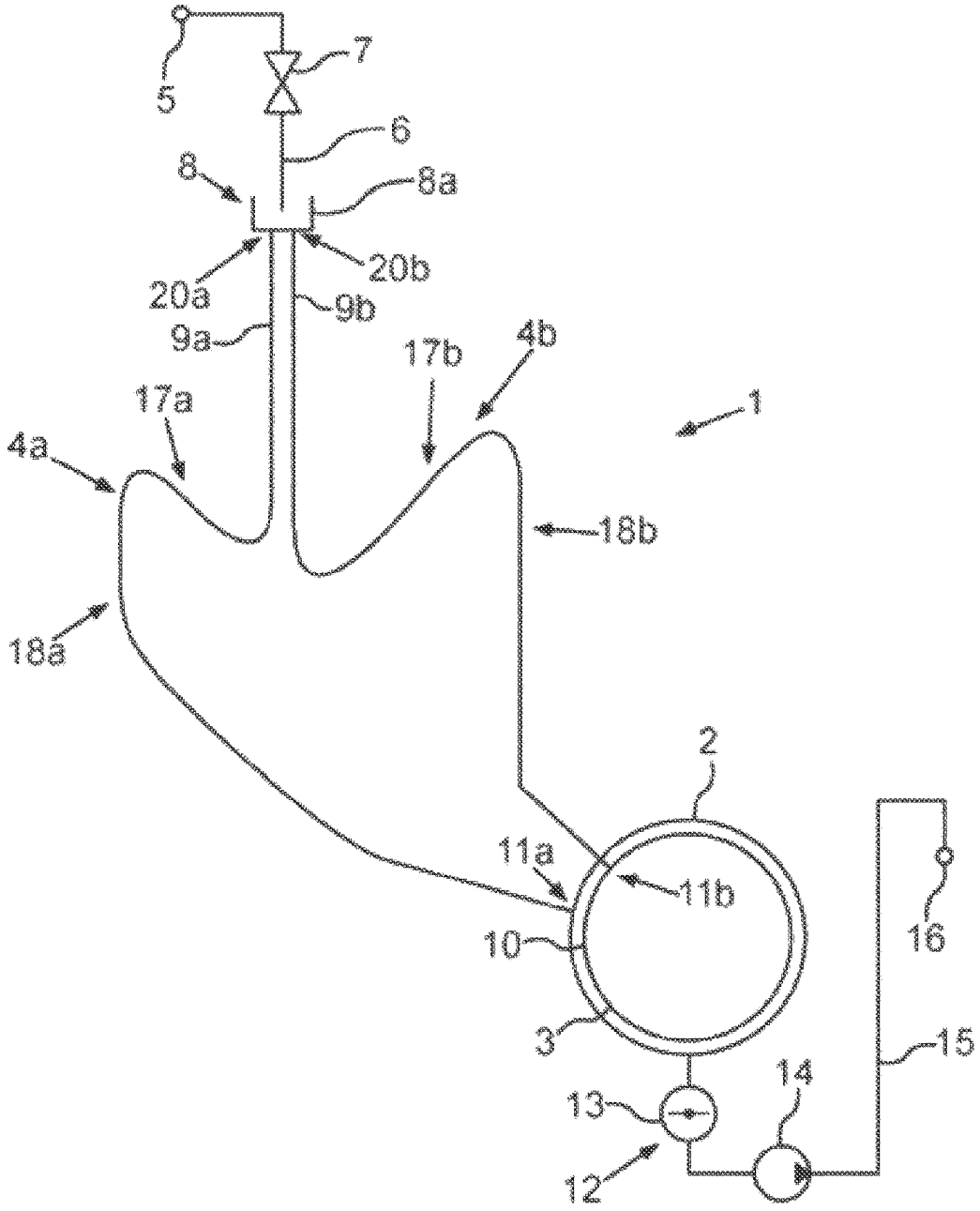
FIG. 1 shows a schematic diagram of an exemplary embodiment of an inventive domestic appliance.

In the figures, elements that are the same or have the same functions are labeled with the reference characters.

FIG. 1 shows a washing machine as a water-conducting domestic appliance, which is embodied for the care of laundry items. The domestic appliance 1 can also be a washer-dryer however.

The domestic appliance 1 has a tub 2 in which a drum 3 for accommodating the laundry items is disposed and is rotatable around an axis of rotation at right angles to the plane of the figure.

In addition the domestic appliance 1 has a first supply line 4*a*, via which fresh water is able to be conveyed into the drum 3. Furthermore a connection 5 is embodied which is able to be connected to a domestic water installation or the like. From the connection 5 a fresh water line 6 leads into the interior of the domestic appliance 1. A stop valve 7 is disposed in the fresh water line 6 which is activated for example by a controller in accordance with the program sequence, for example for a rinsing process for wetting laundry items. The fresh water line 6 leads via a free air path into a rinsing dish 8*a* of a rinsing arrangement 8. A laundry care medium, especially a detergent, can be provided in the rinsing dish 8*a* for example, which is flushed with the fresh water through a line 9*a* of the supply line 4*a*.

The domestic appliance 1 has a flexible door seal 10, which is connected to the tub 2.

As can be seen from the diagram in FIG. 1, the first supply line 4*a* opens via a first supply point 11*a* at the tub 2. A tube section of the supply line 4*a* opens at this inlet point 11*a* on the tub 2. This enables fresh water and if necessary a mixture of fresh water and a laundry treatment medium to also be conveyed via the supply line 4*a* into the drum 3.

The domestic appliance 1 also has a drain pump line 12 comprising a closure flap 13, a washing liquor pump 14 and a line 15. When the closure flap 13 is open washing liquor provided in the tub 2 can be pumped by actuation of the washing liquor pump 14 via the line 15 to an outlet 16.

The outlet 16 in this case can be connected to a suitable outflow of a domestic water installation or the like.

Embodied in the supply line 4*a* is a steam stop facility 17*a*. This is embodied in a curved line section 18*a* of the supply line 4*a*. The steam stop facility 17*a* is formed by a water supply device.

As the diagram in FIG. 1 also shows, the supply line 4*a* opens out at the inlet point 11*a* on the tub 2, wherein the rinsing dish 8*a* of the rinsing arrangement 8 opens out on the other side at the opening 20*a*.

In addition a second supply line 4*b* is provided in the exemplary embodiment, which likewise has a line section 18*b*, in which a curved upper section is embodied. Here too a steam stop facility 17*b* is embodied. Via the line 9*b*, a connection between the rinsing dish 8*a* and the further supply line 4*b* is embodied via a further opening 20*b* into the rinsing dish 8*a*. The further supply line 4*b* opens out on the other side at an inlet point 11*b* on the door seal 10, which is located between the tub 2 and the drum 3.

In the exemplary embodiment there is provision for the supply line 4*b* to be embodied without a specific ventilation channel, such as is provided for the supply line 4*a*.

The washing machine 1 and the controller of said machine are designed, during a process of introducing the water, so that optionally the water or the liquid are able to be supplied via the line section 18*a* or via the line section 18*b* to the tub 2 or the drum 3. The line section 18*a* is explained in greater detail with reference to the subsequent figures.

Figure 2:
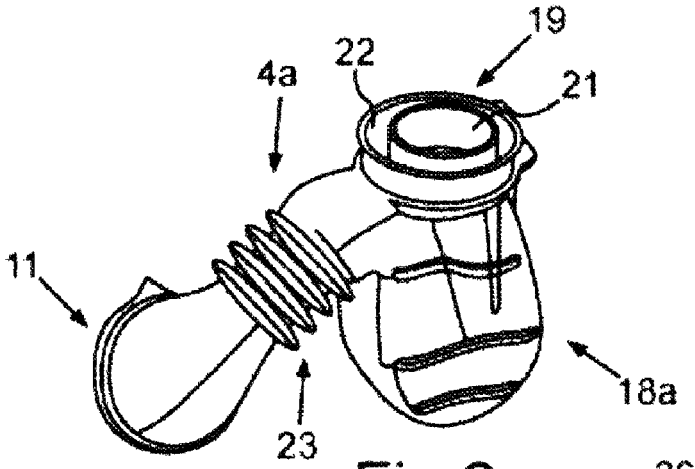
FIG. 2 shows a perspective diagram of a supply line of a domestic appliance in accordance with FIG. 1.

To this end FIG. 2 shows a perspective diagram of the supply line 4*a* with the line section 18*a*. The line section 18*a* has an upper end 19, which is connected to a connector 20*a* of the rinsing dish 8*a*. A supply channel 21 opens at this upper first end 19 and a ventilation channel 22 separated from said supply channel. At this first end 19 these two channels 21 and 22 are designed to open into continuations for connection thereto and additionally also be separated from one another.

The line section 18*a*, which in the exemplary embodiment represents the supply line 4*a*, is a one-piece injection-molded part. It is predominantly embodied rigid and only has a flexible channel section 23, which takes the form of a corrugated tube, in a center section.

Figure 3:
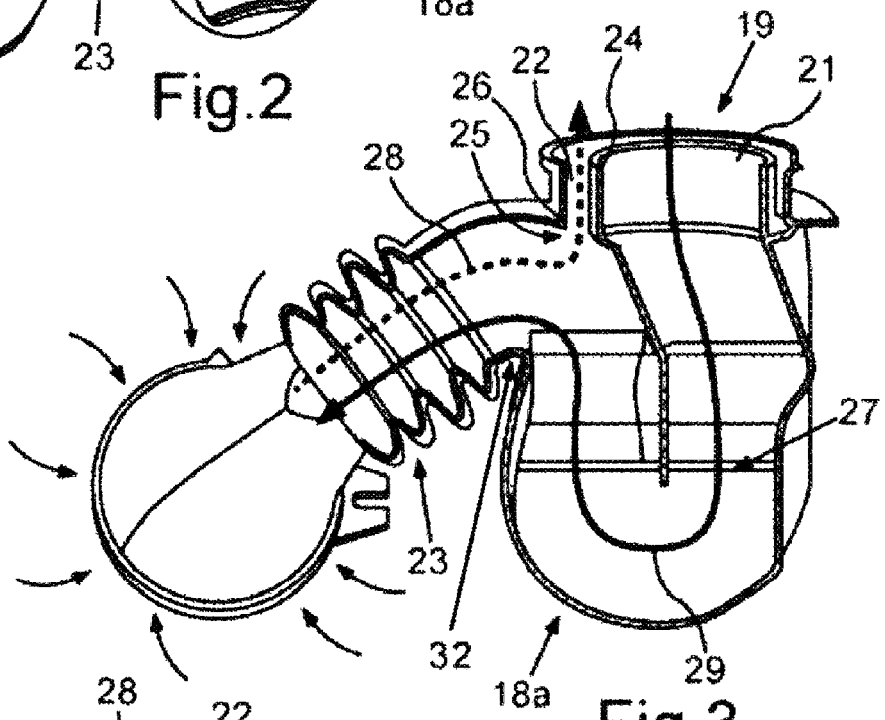
FIG. 3 shows a sectional diagram through the embodiment in accordance with FIG. 2.

FIG. 3 shows a view of the line section 18*a* in accordance with FIG. 2 partly as a sectional diagram. As can be seen from the diagram in FIGS. 2 to 4, at this first end 19 the ventilation channel 22 is embodied not entirely running all around the supply channel 21, but is only designed to line around said channel in some areas. The ventilation channel 22 is separated from the supply channel 21 by a dividing wall 24.

As can be seen from the diagram in FIG. 3, the first end 19, in respect of elevation is an upper end viewed in terms of level.

The ventilation channel 22 opens out with its lower end 25 facing away from the upper end 19 into the supply channel 21 embodied as a curved channel.

A confluence point 26 in this regard is embodied higher in terms of level than a liquid level 27 in the supply channel 21. The steam stop is embodied by the design of a dividing wall 24 and the liquid level 27 which extends above the lower end of the dividing wall 24. This liquid level 27 lies below the confluence point 26. The process air 28, which is shown by the corresponding arrow, can thus be readily transported away via the supply line 4*a* and the ventilation channel 22 into the rinsing dish 8*a*. On the other hand the liquid medium 29 in the form of the fresh water and possibly an added detergent can be conveyed, as shown by the arrow, from the rinsing dish 8*a* via the line section 18*a* embodied as a curved piece of tube to the inlet point 11*a*.

As can also be seen in FIG. 3, the flexible channel section 23 is embodied in the supply channel 21 and is thus disposed after the confluence point 26 of the ventilation channel 22. As can additionally be seen from FIG. 3, the confluence point 26 is also, viewed in terms of level, disposed above a kinked area 32 of the supply channel 21, wherein this kinked area 32 is subsequently disposed at the curvature of the supply channel 21, in which curvature of the steam stop is embodied. Even if a corresponding overflow of the liquid beyond this kinked area 32 takes place or the liquid level 27 were to rise up to this kinked point 32, a ventilation process via the ventilation channel 22 is still easily made possible. This ventilation channel 22, as already mentioned, then opens out into a ventilation channel not shown in any greater detail in the rinsing dish 8*a*, wherein the venting channel can then be routed there so that it is in contact with a delimiting wall which delimit the volume area in which the liquid medium is contained. This causes the process air to be conveyed for as long as possible along a condensation area and then from said area back to the front again, in order especially to be able to emerge on the front side from the rinsing dish 8*a*.

Figure 4:
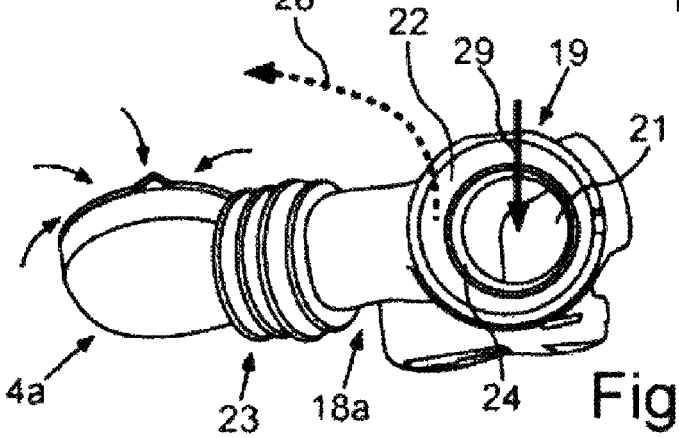
FIG. 4 shows a perspective overhead view of the embodiment in accordance with FIG. 2 and FIG. 3.

FIG. 4 shows in a perspective overhead view, the upper first end 19. The outlet or opening area of the ventilation channel 22 embodied as a ring section can be seen in this diagram.

Figure 5:
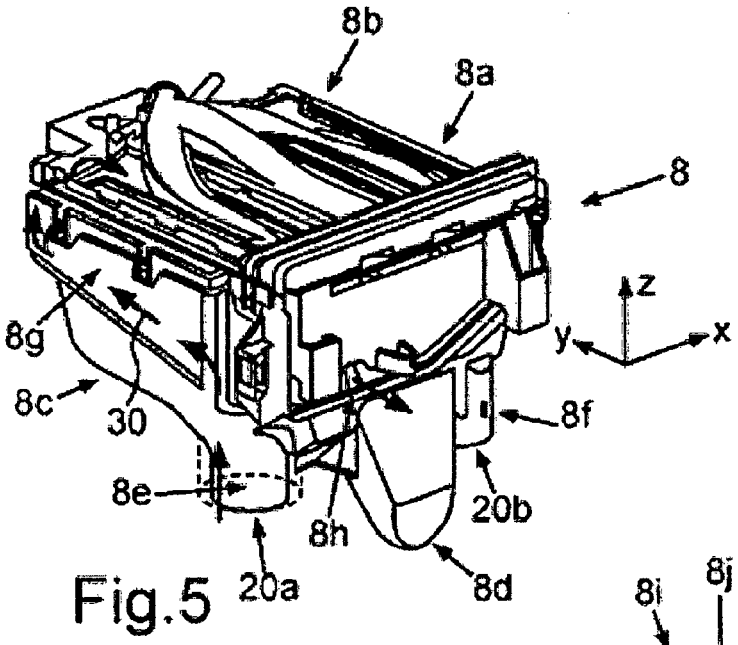
FIG. 5 shows a perspective diagram of an exemplary embodiment of a rinsing arrangement with a rinsing dish.

FIG. 5 shows a perspective diagram of an exemplary embodiment of the rinsing arrangement 8 with the rinsing dish 8*a*.

The rinsing dish 8*a* comprises an upper portion 8*b* and a lower portion 8*c*, which are manufactured as separate parts, for example as one-piece injection-molded parts, and can be connected to one another, for example latched onto one another.

Embodied in the rinsing dish 8*a* in the lower portion 8*c* is a water supply device 8*d* with a water-receiving tray. The water-receiving tray, in the present exemplary embodiment according to the diagram in FIG. 7, which shows a section A-A through the rinsing arrangement 8 along the x-z plane, is a siphon.

Embodied on the lower portion 8*c* is an outlet connector 8*e*, to which the line section 18*a* is able to be connected via the line 9*a*.

The line section 18*b* is then able to be connected via the line 9*b* to a further outlet connector 8*f*, which is integrated onto the lower portion 8*c*.

As can further be seen from the diagram in FIG. 5, a venting channel 8*g* is embodied in the outlet connector 8*e* and in its further continuation, wherein the diagram is shown in a partly broken view here, so that the inside of the channel 8*g* can be seen. In the connected state of the line section 18*a* on the outlet connector 8*e* the air is then routed via the ventilation channel 22, according to the arrow direction 30 shown, into the venting channel 8*g* in the rinsing dish 8*a*. This is routed in this case from a front end of the rinsing dish 8*a*, on which the outlet connector 8*e* is embodied, via the entire depth (y-direction) backwards, and from there blown out forwards again and via a front-side opening 8*h* from the rinsing dish 8*a*.

Figure 6:
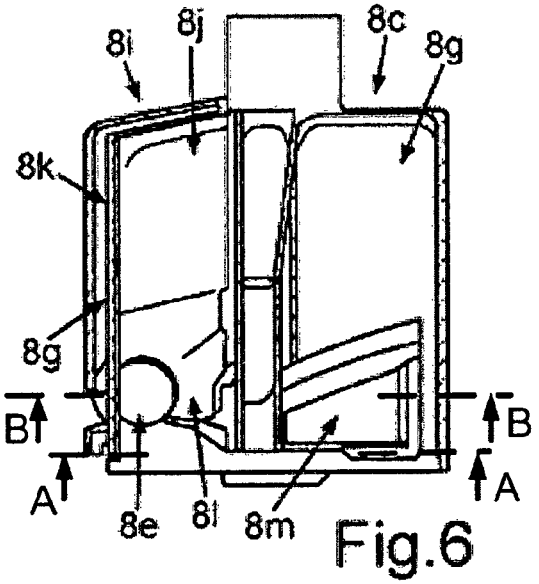
FIG. 6 shows a horizontal sectional diagram through the embodiment according to FIG. 5.

From the diagram in accordance with FIG. 6 it can be seen that the very narrow venting channel 8*g* is delimited inwards by a delimiting wall 8*i*. This wall 8*i* is at the same time also the delimiting wall of a water-receiving space 8*j* in the lower portion 8*c*. The water to be found therein, which may also include a detergent, is then conveyed via the supply channel 21 to the tub 2.

Through the quite specifically constructed and disposed venting channel 8*g* the air is routed for as long as possible past the area of the water-receiving area 8*j* to which water is applied, so that a corresponding condensation can take place.

The embodiment of the rinsing dish 8*a* is also provided so that a part channel 8*k* is embodied in the lower portion 8*c* which, with a further part channel in the upper portion 8*b*, forms the closed overall venting channel 8*g*.

In addition there is provision for the upper portion 8*b* to have a guide wall not shown in the figure through which, in the assembled state of the upper portion 8*b* with the lower portion 8*c*, an inner space of rinsing dish 8*a* is divided into two rinsing channels 8*l* and 8*m*. A first rinsing channel 8*m* is embodied with the water supply device as a steam stop. A second rinsing channel 8*l* is embodied with a water supply device as a connection to the tub 3.

Figure 7:
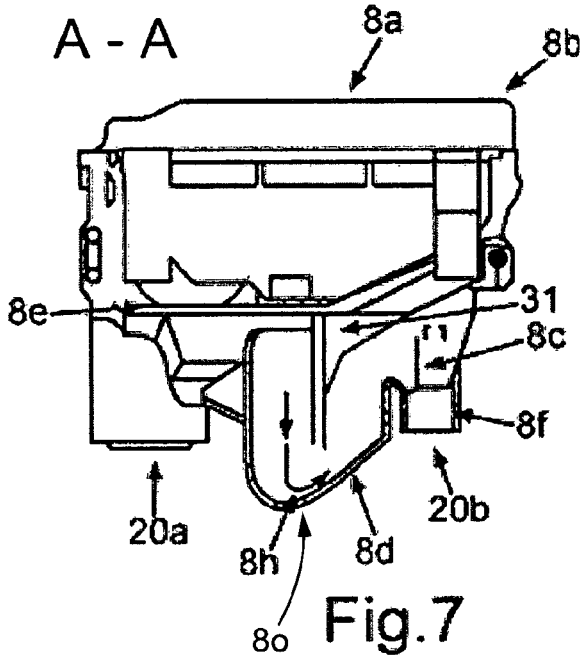
FIG. 7 shows a diagram of the vertical section A-A through the embodiment according to FIG. 5.

In the diagram in FIG. 7 already discussed, the embodiment of the water supply device 8*d* embodied as siphon 8*n* and represented as a broken-view diagram is shown. This is integrated into the lower portion 8*c*.

For easier manufacturing of the lower portion 8*c* as a one-piece injection-molded part there is initially provision for only the water tray to be made. To create the siphon a dividing wall 31 is then manufactured as a one-piece separate component and provided, of which a lower end 31*b* is then able to be inserted into the lower portion 8*c* in the area of the water tray, especially is able to be positioned there by latching it. To this end, the end state with this dividing wall 31 already in position is shown in FIG. 7, by which the siphon-type embodiment of the water tray of the water supply device 8*d* is then produced and the flow path of the liquid medium is shown in accordance with the arrows shown in FIG. 7.

Figure 8:
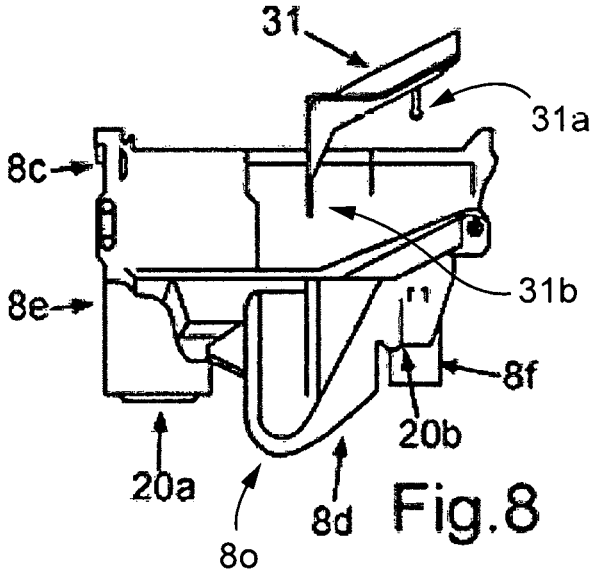
FIG. 8 shows a further diagram of the embodiment in FIG. 7.

To this end a side view is shown in FIG. 8, in which the dividing wall 31 is removed. In FIG. 8, an attaching portion 31*a* is visible, and in FIG. 7-9, base portion 8*o* is visible. With such an embodiment of the rinsing dish 8*a* a quite specific water supply system for the rinsing is embodied which prevents the escape of steam from the tub 3 during the washing and drying cycle using a secure process. This is done via the water supply in the integrated siphon 8*n* in the rinsing dish 8*a*.

If water runs from the rinsing dish 8*a* to the door seal between the tub 2 and the drum 3, the said water supply system will be completely flooded. In such a case water flows through the channel.

Figure 9:
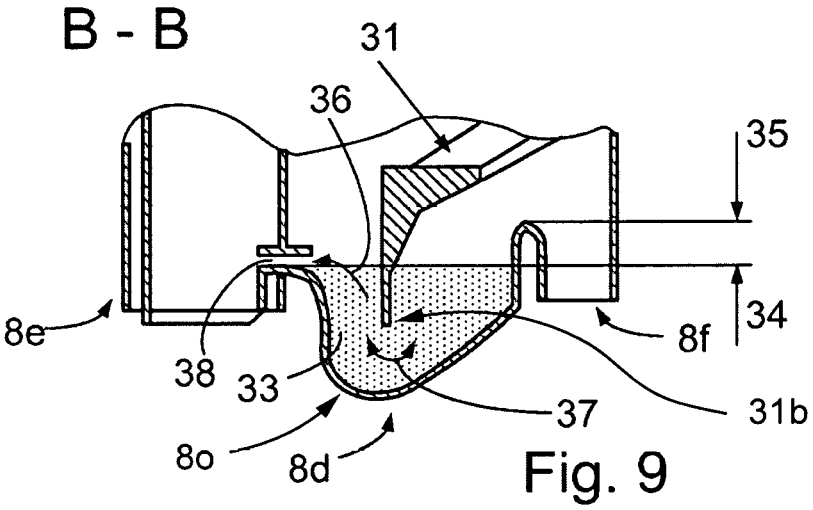
FIG. 9 shows a lower portion diagram of the vertical section B-B through the embodiment according to FIG. 5.

FIG. 9 shows, in a section B-B through the rinsing arrangement 8 along the x-z plane, the water supply device 8*d* with the water-receiving tray, which is filled up to the overflow level 34 of the second overflow with the supply medium 33, especially with water or liquid. If a further water or liquid now flows into the water supply device 8*d* it will reach the outlet connector 8*e* via the second overflow along the arrow 36, since the overflow level 34 of the second overflow is lower than the overflow 35 of the first overflow.

Disposed between the outlet connector 8*e* and the water supply device 8*d* is an overflow channel 38. As shown in FIG. 9, the overflow channel is disposed in the area of the second overflow. The level of the overflow channel is lower than the first overflow level 35. If more water or liquid is now supplied to the water supply device 8*d* per unit of time than can flow out via the overflow channel 38, the level of the supply medium 33 will rise in the water supply device 8*d*. When the level of the supply medium 33 has reached the first overflow level 35, the water or liquid supplied to the supply medium 33 will flow out via the outlet connector 8*f*. Since the cross-section of the overflow channel is smaller than the cross-section of the outlet connector 8*f*, a greater proportion of the supplied water or of the liquid will escape via the outlet connector 8*f* than via the outlet connector 8*e* from the rinsing arrangement 8.

During the operation of the washing machine 1 there is provision in accordance with the exemplary embodiment for a direct wetting of the laundry items only to take place during a rinsing process. In such cases water or liquid flows from the rinsing dish 8*a* to the door seal 10 between the tub 2 and the drum 3 so that the said water supply system, especially the steam stop facility 17*b*, is completely flooded. In this case the water or the liquid flows through the lines 9*b* and 18*b*.

In the exemplary embodiment the cross-sectional the overflow channel 38 is adapted to the predetermined water supply flow or the liquid flows such that, during a rinsing process the water supplied via the connection 5 will essentially escape from the outlet connector 8*f* and only a small leakage will flow via the overflow channel 38. Thus for example in the rinsing process a direct wetting of laundry items introduced into the washing machine 1 is possible since in accordance with the exemplary embodiment the outlet connector 8*f* is connected via the line 9*b* to the inlet point 11*b* and the inlet point 11*b* directs the escaping water or liquid directly into the drum 3 and thus onto the laundry.

The water or liquid remaining in the water supply device 8*d* bring about a steam or odor stop. The supply medium 33 is put into motion during the remaining operation of the washing machine 1 however because of device oscillations of vibrations or during fluctuations in pressure, especially during closing and opening of a loading opening of the washing machine 1. Such motion is shown in FIG. 9 with the arrow 37. The motion of the supply medium 33 causes an overflow of the same, which is why apart of the supply medium 33 will escape via the lower overflow, i.e. the second overflow. This part will then flow out via the overflow channel 38 and the outlet connector 8*e* into the line 9*a*. As is shown in FIG. 1, the line 9*a* is connected to the tub 2 and not to the door seal 10, which is why with such an overflow an unwanted wetting of the laundry items with the supply medium 33 can be avoided. It can therefore also be excluded that, when the already spun laundry items are being taken out by opening the loading opening, which can lead to pressure fluctuations in the water supply system, the laundry items will be wetted again with supply medium 33 escaping from the water supply device 8*d*.

LIST OF REFERENCE CHARACTERS

1 Domestic appliance
2 Tub
3 Drum
4*a* Supply line
4*b* Supply line
5 Connection
6 Fresh water line
7 Stop valve
8 Rinsing arrangement
8*a* Rinsing dish
8*b* Upper portion
8*c* Lower portion
8*d* Water supply device
8*e* Outlet connector
8*f* Outlet connector
8*g* Venting channel
8*h* Opening
8*i* Dividing wall
8*j* Water receiving space
8*k* Sub-channel
8*l* Rinsing channel
8*m* Rinsing channel
8*n* Siphon
9*a* Line
9*b* Line
10 Door seal
11*a* Inlet point
11*b* Inlet point
12 Drain pump line
13 Closure flap
14 Washing liquor pump
15 Line
16 Output
17*a* Steam stop facility
17*b* Steam stop facility
18*a* Line section
18*b* Line section
19 First upper end
20*a* Opening
20*b* Opening
21 Supply channel
22 Ventilation channel
23 Channel section
24 Dividing wall
25 Lower end
26 Confluence point
27 Liquid level
28 Process air

29 Medium
30 Arrow direction
31 Separating wall
32 Kinked area
33 Supply medium
34 Overflow level of the second overflow
35 Overflow level of the first overflow
36 Direction of the overflow
37 Movement direction of the supply medium

The invention claimed is:

1. A rinsing arrangement for a domestic appliance for care of laundry items, comprising:

a rinsing dish, having an upper portion and a lower portion removably connectable to the upper portion;

a water supply device with a water-receiving tray formed in the lower portion, an outlet connector, which opens out into the water-receiving tray, is formed on the lower portion, and a dividing wall separately and directly attachable to the lower portion wherein, when the dividing wall is attached to the lower portion with a lower end of the dividing wall being spaced away from a base portion of the water supply device, a siphon is formed between the outlet connector and a water-receiving space formed in the lower portion, the lower end of the dividing wall being positioned within the siphon.

2. The rinsing arrangement as claimed in claim 1, wherein the dividing wall is disposed on the lower portion so as to be able to be released therefrom without destroying the lower end of the dividing wall.

3. The rinsing arrangement as claimed in claim 1, wherein the dividing wall is a one-piece plastic part.

4. The rinsing arrangement as claimed in claim 1, wherein the dividing wall is able to be attached to the lower portion by latching it onto said portion.

5. The rinsing arrangement as claimed in claim 1, wherein the upper portion has a guide wall, through which, in the assembled state of the upper portion with the lower portion, the interior of the rinsing dish is divided into two rinsing channels.

6. The rinsing arrangement as claimed in claim 5, wherein a first rinsing channel is embodied with the water supply device as a steam stop.

7. The rinsing arrangement as claimed in claim 5, wherein a second rinsing channel is embodied with the water supply device as a connection to a tub of the domestic appliance.

8. The rinsing arrangement as claimed in claim 1, wherein the siphon has a first overflow to the outlet connector and a second overflow to a further outlet, wherein the overflow level of the first overflow is disposed higher than the overflow level of the second overflow.

9. The rinsing arrangement as claimed in claim 8, wherein an overflow channel, which has a smaller cross-sectional surface than a cross-sectional surface of the outlet connector, is disposed between the water supply device and the further outlet and the elevation of which is disposed below the overflow level of the first overflow.

10. The rinsing arrangement as claimed in claim 9, wherein the overflow channel forms the second overflow.

11. A domestic appliance for care of laundry items with a rinsing arrangement as claimed in claim 1.

12. The domestic appliance as claimed in claim 11, wherein said domestic appliance is a washing machine or a washer-dryer.

13. The rinsing arrangement as claimed in claim 1, wherein the lower end of the dividing wall is positioned below an overflow level of the outlet connector.

14. The rinsing arrangement as claimed in claim 1, wherein the dividing wall includes an attaching portion upwardly and laterally spaced from the lower end.

15. The rinsing arrangement as claimed in claim 1, wherein the dividing wall includes an attaching portion to connect to the lower portion, the attaching portion extending in a direction substantially parallel to the dividing wall.

* * * * *